US010690107B1

(12) United States Patent
Anders et al.

(10) Patent No.: US 10,690,107 B1
(45) Date of Patent: Jun. 23, 2020

(54) COMPOSITE SPARK AND LIQUID PILOT IGNITER FOR DUAL FUEL ENGINE

(71) Applicant: Caterpillar Inc., Deerfield, IL (US)

(72) Inventors: Jonathan W. Anders, Peoria, IL (US); Bobby John, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/278,310

(22) Filed: Feb. 18, 2019

(51) Int. Cl.
*F02P 15/08* (2006.01)
*F02M 61/18* (2006.01)
*F02P 5/145* (2006.01)

(52) U.S. Cl.
CPC ..... *F02P 15/08* (2013.01); *F02M 61/1806* (2013.01); *F02P 5/145* (2013.01)

(58) Field of Classification Search
CPC ..... F02P 15/08; F02P 5/145; F02M 61/1806
See application file for complete search history.

(56) References Cited

U.S. PATENT DOCUMENTS

| | | | | |
|---|---|---|---|---|
| 5,715,788 | A | 2/1998 | Tarr et al. | |
| 5,983,855 | A | 11/1999 | Benedikt et al. | |
| 6,032,617 | A | 3/2000 | Willi et al. | |
| 6,536,405 | B1 | 3/2003 | Rieger et al. | |
| 8,763,401 | B2 * | 7/2014 | Patel | F02C 7/22 60/740 |
| 2006/0169244 | A1 | 8/2006 | Allen | |
| 2008/0072871 | A1 | 3/2008 | Vogel et al. | |

FOREIGN PATENT DOCUMENTS

| | | | |
|---|---|---|---|
| DE | 102006029210 | A1 | 12/2007 |
| JP | 2008255837 | A | 10/2008 |

* cited by examiner

*Primary Examiner* — Hieu T Vo
(74) *Attorney, Agent, or Firm* — Brannon Sowers & Cracraft

(57) ABSTRACT

An igniter for a dual fuel engine includes a plurality of spray orifices formed in a nozzle and defining a plurality of spray axes. A plurality of spark electrodes are resident on the nozzle and form spark gaps offset from the spray axes, in a spark gap pattern that is at variance in at least one of a circumferential aspect or an axial aspect with the spray plume pattern.

20 Claims, 2 Drawing Sheets

COMPOSITE SPARK AND LIQUID PILOT IGNITER FOR DUAL FUEL ENGINE

TECHNICAL FIELD

The present disclosure relates generally to an igniter for a dual fuel engine, and more particularly to an igniter having liquid fuel spray orifices and spark electrodes arranged to avoid interaction between liquid fuel spray plumes and the spark electrodes.

BACKGROUND

Internal combustion engines are widely used throughout the world for vehicle propulsion, electric power generation, handling of liquids and gases, and in various industrial applications. Fuel and air is combusted within an engine cylinder in a conventional operating scheme to produce a rapid rise in pressure that drives a piston coupled with a crankshaft. Spark-ignited engines typically employ a liquid petroleum distillate fuel such as gasoline, or gaseous fuel such as natural gas, methane, propane, mixtures of these, and various others. Compression-ignition engines utilize fuels such as diesel distillate fuel, biodiesel, and others that can be autoignited with air in a compression stroke of a piston. Research interest in recent years has increasingly gravitated toward flexibility of engines with regard to fuel utilization, especially utilization of gaseous fuels. Fuel prices are often dynamic, and certain gaseous fuels can have combustion or emissions characteristics which it is desirable to exploit. Certain engines allow for operation on both or either liquid fuels such as diesel distillate and natural gas or other gaseous fuels. Diesel alone is relatively easy to autoignite, but can have undesirable emissions. Natural gas, on the other hand, in some instances can exhibit ignition problems such as ignition failure or knock, or suffer from problems of combustion stability. In so-called lean burn applications, where gaseous fuel and air are attempted to be burned at a stoichiometrically lean equivalence ratio, such challenges can be particularly acute.

Dual fuel engines where a combustion-initiating pilot injection of liquid fuel is used to ignite a main charge of gaseous fuel address some of these issues with combustion predictability and controllability. In still other proposed dual fuel engines, a spark plug can be used to ignite the main charge of gaseous fuel, with liquid fuel injection used when operating in a diesel-only mode. Each of these general approaches suffer from a variety of drawbacks, but have certain advantages. Packaging concerns where both a fuel injector and a spark plug are used in the same engine exist, as well as potentially increased costs with an increased number of parts. One example of a dual fuel engine employing a diesel pilot fuel to ignite natural gas is known from U.S. Pat. No. 6,032,617 to Willi, et al.

SUMMARY OF THE INVENTION

In one aspect, an igniter for a dual fuel engine includes an igniter body defining a longitudinal axis extending between a first igniter body end and a second igniter body end including a nozzle. The igniter body further has formed therein a fuel inlet, and a nozzle supply passage extending between the fuel inlet and the nozzle. The nozzle has a plurality of spray orifices formed therein, and an outlet check movable between an open position at which the plurality of spray orifices are in fluid communication with the nozzle supply passage, and a closed position. The plurality of spray orifices define a plurality of spray axes advancing radially outward and axially outward from the nozzle. A plurality of spark electrodes are mounted to the second igniter body end and form a plurality of spark gaps that are offset from the plurality of spray axes.

In another aspect, an ignition system for a dual fuel engine includes an engine head structured to couple with a cylinder block in a dual fuel engine having a combustion cylinder formed therein. A fuel supply conduit is formed in the engine head. The ignition system further includes an igniter mounted in the engine head and including a nozzle, an outlet check positioned at least partially within the nozzle, and a plurality of spark electrodes. The igniter has formed therein a fuel inlet in fluid communication with the fuel supply conduit, a nozzle supply passage extending between the fuel inlet and the nozzle, and a plurality of spray orifices formed in the nozzle. The plurality of spray orifices define a plurality of spray axes advancing radially outward and axially outward from the nozzle and arranged in a spray plume pattern. The plurality of spark electrodes form a plurality of spark gaps arranged in a spark gap pattern that is at variance in at least one of a circumferential aspect or an axial aspect with the spray plume pattern.

In still another aspect, a nozzle for an igniter in a dual fuel engine includes a nozzle body defining a longitudinal axis and having a nozzle cavity formed therein, and a nozzle tip including a plurality of spray orifices connecting to the nozzle cavity. The nozzle further includes a plurality of spark electrodes resident on the nozzle body. The plurality of spray orifices define a plurality of spray axes advancing radially outward and axially outward from the nozzle body and arranged in a spray plume pattern. The plurality of spark electrodes form a plurality of spark gaps arranged in a spark gap pattern that is at variance in at least one of a circumferential aspect or an axial aspect with the spray plume pattern.

DETAILED DESCRIPTION

Figure 1:
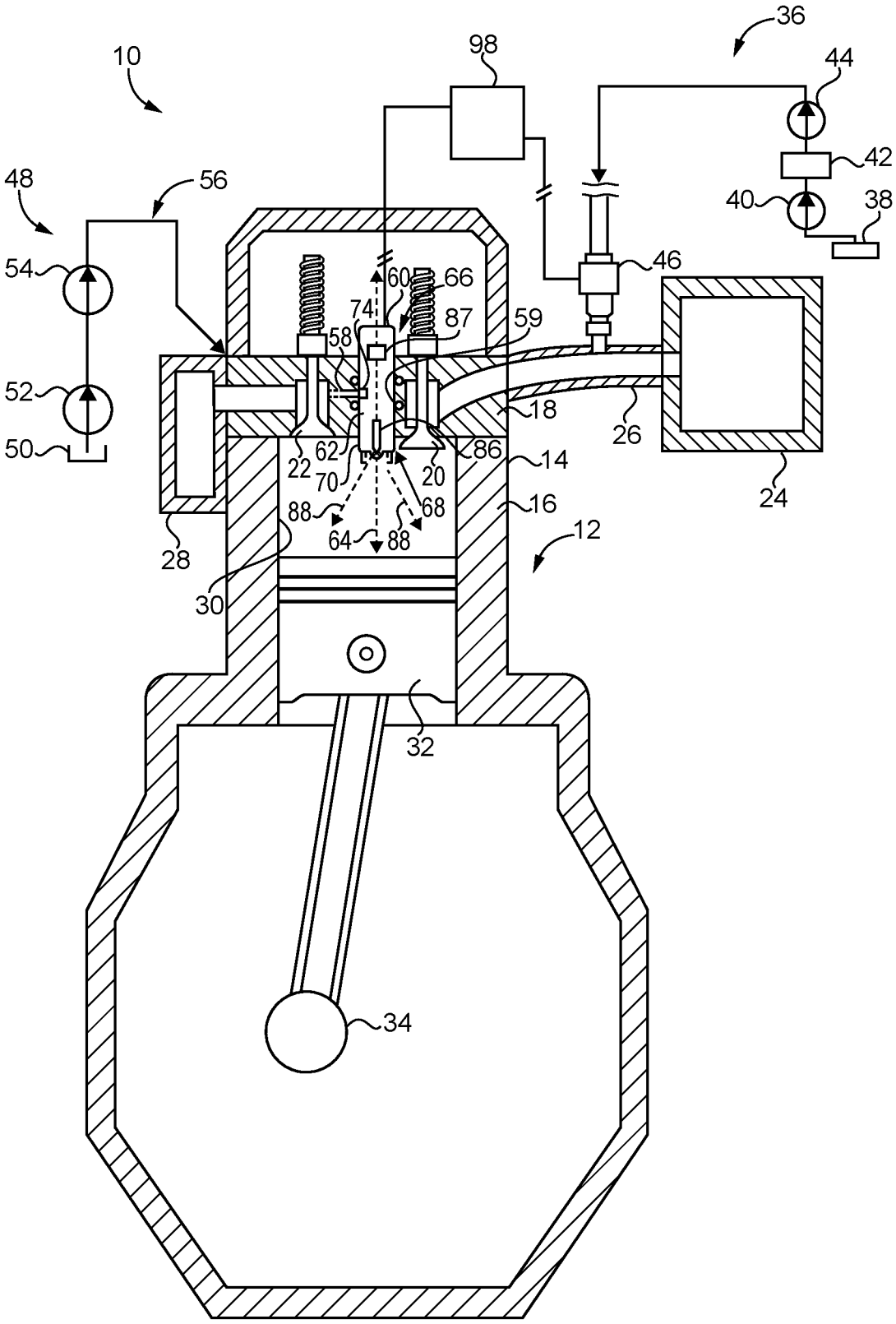
FIG. 1 is a partially sectioned side diagrammatic view of a dual fuel engine system, according to one embodiment.

Referring to FIG. 1, there is shown a dual fuel engine system 10 according to one embodiment, and including an internal combustion engine 12 having an engine housing 14 with a cylinder block 16 and an engine head 18 structured to couple with cylinder block 16. An intake valve 20 and an exhaust valve 22 are mounted within engine head 18. Intake valve 20 is movable to open and close fluid communications with an intake runner 26 fluidly connecting with an intake manifold 24. Exhaust valve 22 is movable to open and close fluid communications with an exhaust manifold 28. A cylinder 30 is formed in cylinder block 16, and a piston 32 is movable in a conventional four-cycle pattern, for example, between a top dead center position and a bottom dead center position in cylinder 30 to rotate a crankshaft 34 in a generally conventional manner.

In FIG. 1 only a single cylinder is shown in engine 12, however, it will be appreciated that engine 12 can have any number of cylinders arranged in any suitable configuration such as an in-line configuration, a V-configuration, or still another. It will further be appreciated that a plurality of intake runners could be connected with intake manifold 24 to fluidly connect to other cylinders of engine 12. Intake manifold 24 can receive a flow of intake air, such as compressed intake air received from a turbocharger compressor, and distribute the intake air for combustion to cylinder 30 and other cylinders of engine 12.

A gaseous fuel system 36 is provided to supply a gaseous fuel such as natural gas, propane, methane, biogas, landfill gas, blends of these, or still others to intake runner 26. In other embodiments gaseous fuel could be supplied to intake manifold 24 directly, or potentially elsewhere in an intake pathway of engine system 10 such as at a location upstream of a turbocharger compressor. Gaseous fuel system 36 includes a gaseous fuel supply 38, such as a cryogenic storage tank storing gaseous fuel in a liquid state. Gaseous fuels as contemplated herein include a fuel that is gaseous at standard temperature and pressure. Gaseous fuel system 36 further includes a cryogenic pump 40 structured to feed the gaseous fuel in a liquid state to a vaporizer 42, and a fuel pressurization pump 44 receiving the gaseous fuel now in a gaseous state from vaporizer 42 and supplying the same to a gaseous fuel admission valve 46 coupled with intake runner 26.

Engine system 10 further includes a liquid fuel system 48 having a liquid fuel supply such as a fuel tank 50, and a fuel transfer pump 52 coupled with fuel tank 50. Fuel transfer pump 52 can transfer liquid fuel, such as diesel distillate liquid fuel, to a high pressure pump 54. High pressure pump 54 pressurizes the liquid fuel to a pressure suitable for injection and supplies the same to a common rail 56 coupled with engine head 18. Although a common rail or like pressure reservoir system is a practical implementation strategy, in other embodiments so-called unit pumps or the like could be used to pressurize fuel for injection. The present disclosure is not limited to any particular liquid fuel or gaseous fuel handling, storage, pressurization, or distribution strategy. Likewise, it will be recalled that gaseous fuel can be supplied at a variety of locations upstream of cylinder 30, but in still other instances the gaseous fuel could be port injected or directly injected. A liquid fuel supply conduit 58 is formed in and extends through engine head 18 and conveys liquid fuel from common rail 56 for direct injection into cylinder 30. It will further be appreciated that description herein of cylinder 30 or any other component in the singular should be understood by way of analogy to refer to any of a number of such components that might be part of engine system 10. As will be further apparent from the following description, engine system 10 may be uniquely configured for operating on liquid fuel in a liquid fuel-only mode, operating on gaseous fuel in a gaseous fuel-only mode, or operating on a charge containing both a liquid fuel and a gaseous fuel in a mixed mode or a liquid fuel pilot ignition mode.

Engine system 10 further includes an igniter 60 mounted in engine head 18, igniter 60 including an igniter body 62 defining a longitudinal axis 64 extending between a first igniter body end 66 and a second igniter body end 68. Second igniter body end 68 includes a nozzle 70 positioned at least partially within cylinder 30. As further discussed herein, igniter body 62 integrates features and functions of liquid fuel injection, including liquid fuel injection for liquid fuel-only operation or liquid fuel pilot ignition, and spark-ignition of a gaseous fuel.

Figure 2:
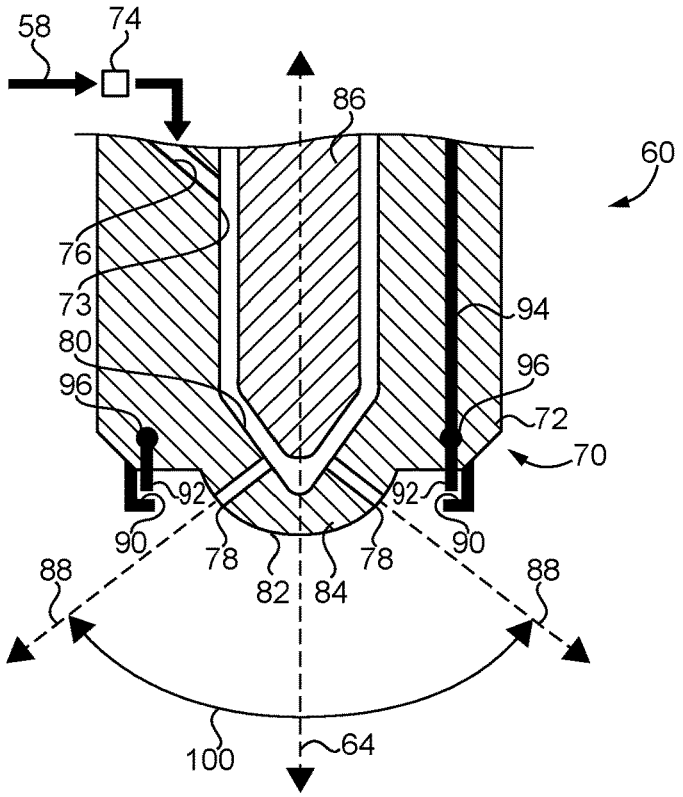
FIG. 2 is a sectioned side diagrammatic view of a portion of an igniter for a dual fuel engine system, according to one embodiment.

Referring also now to FIG. 2, there are shown parts of igniter 60 including nozzle 70 in greater detail. Nozzle 70 includes a nozzle body 72 that can be integral with or formed as one or more separate pieces from igniter body 62. Discussion herein of features of nozzle body 72 should be understood to analogously describe features of igniter body 62 except where otherwise indicated or apparent from the context. Nozzle body 72 can be coaxial with igniter body 62, and therefore understood also to define longitudinal axis 64. Nozzle body 72 further has a nozzle cavity 73 formed therein. Igniter body 62 has formed therein a fuel inlet 74, and a nozzle supply passage 76 extending between fuel inlet 74 and nozzle 70, in particular nozzle cavity 73. Nozzle 70 has a plurality of spray orifices 78 formed therein and extending between a nozzle inner surface 80 and a nozzle outer surface 82. Spray orifices 78 may be formed in a tip 84, such as a bulb, of nozzle 70 and nozzle body 72. Nozzle 70 also includes an outlet check 86 movable between an open position at which spray orifices 78 are in fluid communication with nozzle supply passage 76 by way of nozzle cavity 73, and a closed position at which spray orifices 78 are blocked from fluid communication with nozzle supply passage 76 and nozzle cavity 73. Igniter 60 further includes a control valve assembly 87 as shown in FIG. 1 located within, or potentially outside of, igniter body 62. Control valve assembly 87 can be operably coupled with outlet check 86 and adjustable between a first configuration at which a high fluid pressure such as rail pressure supplied by way of inlet 74 is applied to a closing hydraulic surface (not shown) of outlet check 86, and a second position at which the closing hydraulic surface of outlet check 86 is exposed to a low pressure of a low pressure outlet 59 formed in igniter body 62. Those skilled in the art will recognize control and operation of outlet check 86 as so-called direct control. The general functional relationship and construction of the components of outlet check 86 and control valve assembly 87 can include apparatus and control methodology generally known from the field of liquid fuel injectors and could have a great variety of different forms and constructions.

Spray orifices 78 are thus structured to spray plumes of liquid fuel into cylinder 30 for combustion therein. It will be recalled that injection of liquid fuel can enable a liquid fuel-only or diesel-only mode, or a mode where relatively small liquid fuel pilot shots are injected to ignite or assist in igniting a main charge of a gaseous fuel. Spray orifices 78 define a plurality of spray axes 88 advancing radially outward and axially outward from nozzle 70. According to the present disclosure, "radially inward" and "radially outward" should be understood in reference to longitudinal axis 64. Accordingly, radially inward means toward longitudinal axis 64, and radially outward means away from longitudinal axis 64. "Axially inward" should be understood to mean a direction generally along longitudinal axis 64 and toward or deeper into a physical structure of igniter 60. "Axially outward" means a direction generally along longitudinal axis 64 that is opposite to an axially inward direction. It can be noted from FIG. 2 that spray axes 88 extend away from nozzle tip 84 and also diverge outwardly from nozzle tip 84. Spray orifices 78 can include cylindrical, uniform diameter holes. In other instances, spray orifices 78 could be non-uniform in diameter so as to have an inwardly or outwardly tapered shape, a trumpet shape or the like, or still other shapes. Spay axes 88 can be a center axis defined by each spray orifice 78.

Igniter 60 also includes a plurality of spark electrodes 90 mounted to second igniter body end 68, and in the illustrated embodiment resident on nozzle body 72. Spark electrodes 90 form a plurality of spark gaps 92 that are offset from spray axes 88. It has been discovered that is desirable to avoid interaction between fuel spray plumes and spark gaps in the present disclosure, where the liquid fuel to be injected is compression ignited and not spark-ignited. In other words, whereas in the case of certain liquid fuel spark-ignited engines, fuel spray plumes can be targeted at spark gaps for ignition, in the present disclosure fuel spray plumes are targeted away from spark gaps so as to avoid fouling the spark electrodes, contributing to formation of deposits, neutralizing or inhibiting spark production, or otherwise interfering with the ability of spark electrodes to successfully produce an electrical spark for ignition of gaseous fuel. Spark gaps 92 are thus offset from spray axes 88 for these purposes, the nature of and associated geometry of the offset being further discussed below.

Igniter 60 also includes an electrical line 94 extending through igniter body 62. Electrical line 94 can connect to an electronic control unit or another electrical power supply 98 of the engine system 10 that produces an electrical potential across each spark gap 92 sufficient to stimulate spark production according to well-known principles. Also shown in FIG. 2 are electrical nodes 96 connecting each spark electrode 90 with electrical line 94. In one practical implementation, spark electrodes 90 are electrically connected in parallel. It is contemplated that an electrical potential can be produced at each spark electrode 90, and one of spark gaps 92 that most readily assumes a condition suitable for spark production, including a spark breakdown voltage, will fire. As individual ones of spark electrodes 90 change over time, such as by erosion of material, different ones of spark gaps 92 may actually produce a spark over time.

A spray angle 100 is defined by spray axes 88. In one embodiment, spray angle 100 may be from about 120° to about 150°. In one refinement, such as where igniter 60 is to be used or optimized for a diesel main injection at or near a top dead center position of piston 32 in a liquid-only mode, spray angle 100 might be from about 130° to about 150°. Where igniter 60 is to be optimized for injection of a liquid fuel early pilot shot, such as a pilot shot before a top dead center position of piston 32, spray angle 100 might be from about 120° to about 130°.

Figure 3:
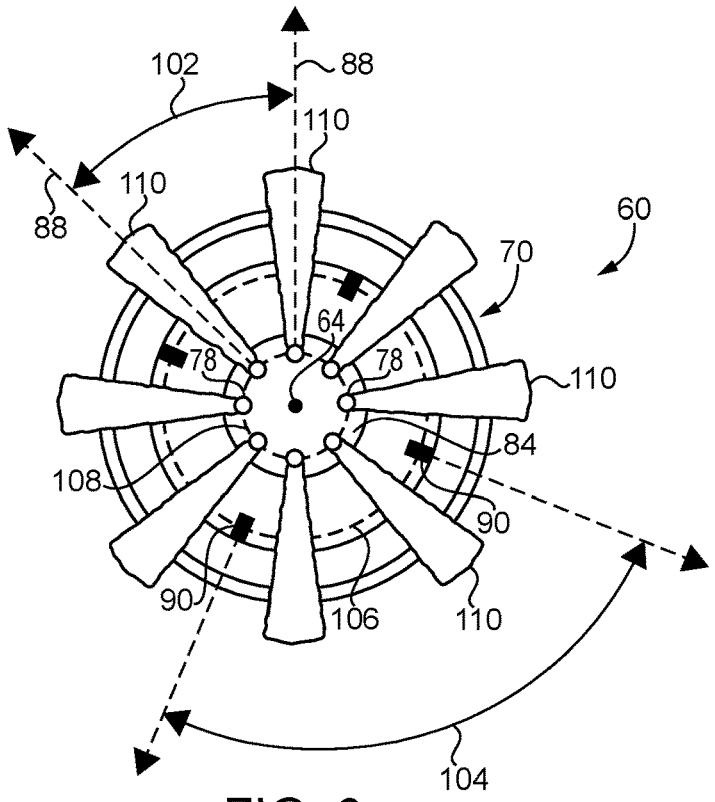
FIG. 3 is a diagrammatic end view of spray plume and spark gap patterns in an igniter for a dual fuel engine system, according to one embodiment.

Referring also now to FIG. 3, there is shown an end view illustrating a plurality of fuel spray plumes 110 sprayed out of spray orifices 78. It can be noted that spark gaps 92 are circumferentially offset from spray axes 88, two of spray axes 88 being shown in FIG. 3 and the others omitted for clarity of illustration. The term "circumferentially offset" can be understood herein to mean that the subject elements do not occupy radially congruent or overlapping positions along the circumference of circles centered on longitudinal axis 64. It can also be noted that spray orifices 78 are located radially inward of spark electrodes 90, and thus radially inward of spark gaps 92. It can further be noted that spark gaps 92 are axially offset from spray axes 88 at radial locations of spark gaps 92. In FIG. 3, spark electrodes 90 and thus spark gaps 92 are uniformly spaced circumferentially around longitudinal axis 64 and are located on a common circle 106 centered on longitudinal axis 64. Spray orifices 78 are located on another common circle 108 also centered on longitudinal axis 64. The radial locations of spark electrodes 90 and thus spark gaps 92 in the illustrated embodiment are thus locations upon circle 106. Considering the illustrations of FIG. 2 and FIG. 3 together, it will be understood that at the subject radial locations of spark gaps 92, an axial clearance extends between spray axes 88 and spark gaps 92.

Spray orifices 78 can be understood to be arranged in a spray plume pattern. Spark gaps 92 can be understood to be arranged in a spark gap pattern. The spark gap pattern is at variance in at least one of a circumferential aspect or an axial aspect with the spray plume pattern. It will therefore be appreciated that spray axes 88 and spark gaps 92 can be understood as shifted or indexed relative to one another circumferentially about longitudinal axis 64. Spark gaps 92 and spray axes 88 can further be understood to be shifted or offset from one another in an axial direction, at least at the radial locations of spark gaps 92. Axial locations of spark gaps 92 and spray orifices 78 could be the same or similar, or could differ, such as by positioning nozzle tip 84 and spray orifices 78 axially outward of spark electrodes 90 and spark gaps 92. Each of these several features of circumferential aspect or axial aspect can contribute to avoidance of interaction between spray plumes 110 and spark electrodes 90, and could be used alone or in combination. In the illustrated embodiment a total number of spark gaps 92 is 4. Spray orifices 78 may have a total number from 6-8, and in the illustrated embodiment include a total number of 8. Each of spark gaps 92 and spray orifices 78 is, respectively, located at a uniform radial distance from longitudinal axis 64. In other embodiments, spark gaps 92 could be located at a varying radial distance from longitudinal axis 64. Likewise, spray orifices 78 could be located at a varying radial distance from longitudinal axis 64. It is still further contemplated that spray orifices 78 or spark gaps 92 could be located at varying axial locations relative to one another within their respective groupings. From the foregoing description it will be appreciated that many different combinations of spark gap location and spray orifice location or orientation could fall within the scope of the present disclosure as providing a spark gap pattern and a spray plume pattern that are at variance with one another circumferentially or axially, in other words in at least one of a circumferential aspect or an axial aspect as discussed herein.

It can also be appreciated from FIG. 3 that a number of spray orifices 78 and a number of spark gaps 92 is different. Spark gaps 92 may be in an alternating arrangement with spray axes 88 of spray orifices 78 about longitudinal axis 64 in a 1-X-1-X pattern, respectively, where X is a number greater than 1. Going circumferentially about longitudinal axis 64, spark gaps 92 and spray orifices 78 could be alternated every other one. Such a configuration would be a 1-1-1-1 pattern, with X=1. In the illustrated embodiment, the 1-X-1-X pattern is 1-2-1-2. An inter-orifice angle 102, meaning an angle defined by adjacent spray axes 88 in a projection plane, might be about 45°. An analogously defined spark gap angle 104 between adjacent spark gaps 92 is about 90° in the illustrated embodiment. The term "about" should be understood herein in the context of conventional rounding to a consistent number of significant digits. Accordingly "about 90" means from 89.5 to 90.4, and so on.

INDUSTRIAL APPLICABILITY

During operation of engine system 10, piston 32 moves within cylinder 30 between a top dead center position and a bottom dead center position. Gaseous fuel system 36 is operated to provide pressurized gaseous fuel to gaseous fuel admission valve 46, which can be electronically controlled by electronic control unit 98 to admit gaseous fuel into intake runner 26 for delivery into cylinder 30 by way of intake valve 20. Liquid fuel system 48 is operated to supply pressurized liquid fuel to igniter 60 for direct injection into cylinder 30.

An injection of liquid fuel can occur when desired by way of lifting outlet check 86 at an appropriate time prior to a top dead center position of piston 32, or at or after the top dead center position of piston 32. The injected liquid fuel can combust within cylinder 30 to commence a pressure and/or temperature rise and flame production, which serves as a main charge, or as a pilot charge to assist in igniting a main charge of gaseous fuel, or even as a post injection for emissions control or other known purposes. Igniter 60 can further be operated at a desired time, in conjunction with or separately from liquid fuel injection to ignite the main charge of gaseous fuel. In a liquid fuel-only mode or a gaseous fuel-only mode a different strategy relying upon only one of a liquid fuel injection as a compression-ignited main charge or spark-ignition of a main charge of gaseous fuel could be used. In any of these cases, based on the geometry of igniter 60, spray plumes 110 will advance outwardly from spray orifices 78 and pass between, below, above, or otherwise in a manner spatially offset from spark electrodes 90 and spark gaps 92, to avoid interaction therewith.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more," Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An igniter for a dual fuel engine comprising:

an igniter body defining a longitudinal axis extending between a first igniter body end and a second igniter body end including a nozzle, and the igniter body further having formed therein a fuel inlet, and a nozzle supply passage extending between the fuel inlet and the nozzle;

the nozzle having a plurality of spray orifices formed therein, and an outlet check movable between an open position at which the plurality of spray orifices are in fluid communication with the nozzle supply passage, and a closed position;

the plurality of spray orifices defining a plurality of spray axes advancing radially outward and axially outward from the nozzle; and a plurality of spark electrodes mounted to the second igniter body end and forming a plurality of spark gaps that are offset from the plurality of spray axes.

2. The igniter of claim 1 wherein the plurality of spark gaps are circumferentially offset from the plurality of spray axes.

3. The igniter of claim 2 wherein:

the plurality of spray orifices are located radially inward of the plurality of spark electrodes; and the plurality of spark gap locations are axially offset from the plurality of spray axes at radial locations of the plurality of spark gaps.

4. The igniter of claim 3 wherein the plurality of spray orifices are from 6-8 in number and define a spray angle from about 120° to about 150°.

5. The igniter of claim 4 wherein the spray angle is from about 120° to about 130°.

6. The igniter of claim 4 wherein the 1-X-1-X pattern is 1-2-1-2.

7. The igniter of claim 2 wherein the plurality of spark gaps are in an alternating arrangement with the plurality of spray axes about the longitudinal axis in a 1-X-1-X pattern, respectively, where X is 1 or greater.

8. The igniter of claim 1 wherein the plurality of spark electrodes are electrically connected in parallel.

9. An ignition system for a dual fuel engine comprising:

an engine head structured to couple with a cylinder block in a dual fuel engine having a combustion cylinder formed therein;

a fuel supply conduit formed in the engine head;

an igniter mounted in the engine head and including a nozzle, an outlet check positioned at least partially within the nozzle, and a plurality of spark electrodes;

the igniter having formed therein a fuel inlet in fluid communication with the fuel supply conduit, a nozzle supply passage extending between the fuel inlet and the nozzle, and a plurality of spray orifices formed in the nozzle; and the plurality of spray orifices defining a plurality of spray axes advancing radially outward and axially outward from the nozzle and arranged in a spray plume pattern, and the plurality of spark electrodes forming a plurality of spark gaps arranged in a spark gap pattern that is at variance in at least one of a circumferential aspect or an axial aspect with the spray plume pattern.

10. The ignition system of claim 9 wherein the plurality of spray orifices are located radially inward of the plurality of spark gaps.

11. The ignition system of claim 10 wherein the plurality of spark gaps are circumferentially offset from the plurality of spray axes, and axially offset from the plurality of spray axes at radial locations of the plurality of spark gaps.

12. The ignition system of claim 11 wherein the plurality of spark gaps are in an alternating arrangement with the plurality of spray axes about the longitudinal axis in a 1-X-1-X pattern, respectively, where X is 1 or greater.

13. The ignition system of claim 12 wherein the plurality of spark gaps are uniformly spaced circumferentially around the longitudinal axis.

14. The ignition system of claim 13 wherein:

the plurality of spark electrodes are electrically connected in parallel and a total number of the plurality of spark gaps is 4; and the plurality of spray orifices are located at a uniform radial distance from the longitudinal axis and a total number of the spray orifices is from 6-8.

15. A nozzle for an igniter in a dual fuel engine comprising:

a nozzle body defining a longitudinal axis and having a nozzle cavity formed therein, and a nozzle tip including a plurality of spray orifices connecting to the nozzle cavity;

a plurality of spark electrodes resident on the nozzle body;

the plurality of spray orifices defining a plurality of spray axes advancing radially outward and axially outward from the nozzle body and arranged in a spray plume pattern; and the plurality of spark electrodes forming a plurality of spark gaps arranged in a spark gap pattern that is at variance in at least one of a circumferential aspect or an axial aspect with the spray plume pattern.

16. The nozzle of claim 15 wherein the plurality of spark gaps are circumferentially offset from the plurality of spray axes, and axially offset from the plurality of spray axes at radial locations of the plurality of spark gaps.

17. The nozzle of claim 16 wherein the plurality of spray orifices are located radially inward of the plurality of spark gaps.

18. The nozzle of claim 17 wherein the plurality of spark gaps are in an alternating arrangement with the plurality of spray axes about the longitudinal axis in a 1-X-1-X pattern, respectively, where X is 1 or greater.

19. The nozzle of claim 18 wherein the 1-X-1-X pattern is 1-2-1-2.

20. The nozzle of claim 15 wherein a total number of the plurality of spark gaps is 4, and a total number of the spray orifices is greater than 4.

* * * * *